US007059599B2

(12) United States Patent
Lewis

(10) Patent No.: US 7,059,599 B2
(45) Date of Patent: Jun. 13, 2006

(54) APPARATUS FOR THE STORAGE AND TRANSPORT OF BANK NOTES

(75) Inventor: Robert Anthony Wilbert Lewis, Leicestershire (GB)

(73) Assignee: Volumatic Limited (GB)

( * ) Notice: Subject to any disclaimer, the term of this patent is extended or adjusted under 35 U.S.C. 154(b) by 32 days.

(21) Appl. No.: 10/362,900

(22) PCT Filed: Aug. 28, 2001

(86) PCT No.: PCT/GB01/03831

§ 371 (c)(1),
(2), (4) Date: Feb. 25, 2003

(87) PCT Pub. No.: WO02/19289

PCT Pub. Date: Mar. 7, 2002

(65) Prior Publication Data

US 2003/0180131 A1 Sep. 25, 2003

(30) Foreign Application Priority Data

Aug. 29, 2000 (GB) ..... 0021014
Aug. 29, 2000 (GB) ..... 0021016

(51) Int. Cl.
*G07D 11/00* (2006.01)

(52) U.S. Cl. ..... 271/213; 232/15; 232/43.2; 109/22; 109/47

(58) Field of Classification Search ..... 271/207, 271/213; 232/1 D, 43.2, 15; 109/45, 46, 109/47, 22

See application file for complete search history.

(56) References Cited

U.S. PATENT DOCUMENTS

| | | | | | |
|---|---|---|---|---|---|
| 3,655,186 | A | * | 4/1972 | Bayha | 271/180 |
| 4,790,476 | A | * | 12/1988 | Tanaka et al. | 232/1 D |
| 5,176,315 | A | | 1/1993 | Homel | |
| 5,595,129 | A | * | 1/1997 | Grobe | 109/22 |
| 5,607,102 | A | * | 3/1997 | Walsh et al. | 232/1 D |
| 5,850,966 | A | * | 12/1998 | Siler et al. | 232/15 |
| 5,890,439 | A | * | 4/1999 | McGunn | 109/47 |
| 6,024,531 | A | * | 2/2000 | Schulze | 414/790.2 |

FOREIGN PATENT DOCUMENTS

| | | |
|---|---|---|
| EP | 0124729 | 11/1984 |
| EP | 0674296 | 9/1995 |
| GB | 2199890 | 7/1988 |
| GB | 2213870 | 8/1989 |
| GB | 2236143 | 3/1991 |
| GB | 2313622 | 12/1997 |

* cited by examiner

*Primary Examiner*—Patrick Mackey
(74) *Attorney, Agent, or Firm*—Akerman &Senterfitt

(57) ABSTRACT

Bank notes placed in a tray (13) are slid into an enclosure (10), whereupon a lever (15) is operated to drive down a plunger (17) which opens flaps (21,22) in the bottom of the tray to displace the notes into a carrier (12) in a lower part of the enclosure. The carrier (12) has snap-fitted into its top a frame (107) which also has flaps (21A,22A) which deflect downward as the money enters a bag (108) provided by elasticated material which spans the frame (107). Thereafter a cover plate (111) seals the frame (107) which can then be removed from the carrier (12) to be transported e.g. to a bank.

14 Claims, 12 Drawing Sheets

APPARATUS FOR THE STORAGE AND TRANSPORT OF BANK NOTES

This invention relates to apparatus for the storage and transport of bank notes.

Typically, at a point of sale such as a cashier's desk in a supermarket, a container is suspended beneath the desk for the intermittent reception of wads of bank notes. It may be used to store notes as they are taken from customers, but more usually it acts as an "overflow" for the till on top of the desk. When the pile of notes of a particular denomination in the till reaches a given level it is transferred to the container, which offers better security than the till. Periodically the loaded containers are taken by security personnel to a bank, or more usually they are taken by the staff to a central counting room, where the money is counted and bagged for transport to the bank.

Containers currently in use are rigid boxes which slide into and out of guides beneath a counter whereby they are supported. Provision is normally made for locking them in position. The front face of a container is upwardly inclined and has an exposed top opening through which a wad of notes can be inserted. Behind the inclined front face is a barrier with a central, vertical slot. A plunger mechanism hinged near the bottom of the barrier can be manipulated, when notes have been inserted, to push them through the slot into the body of the container.

Containers of this kind have numerous drawbacks. They are expensive to produce and are not adequately tamper proof. Money behind the slotted barrier is still accessible through the opening and can be "fished" using, for example, adhesive tape. The relatively clumsy plunger mechanism can trap fingers and damage nails.

An object of one aspect of the present invention is to improve upon current arrangements and to provide a more tamper-proof apparatus which is nevertheless easy to use with less danger of injury.

Security firms are reluctant to handle the rigid containers and require the money to be taken out of them and bagged before they will transport it to the bank. This places considerable demands on the staff of the counting room, which is not justified by any real need that the money should be manually counted before it is taken away. Even if a security firm can be persuaded to take the containers they present transport and storage problems because of their bulk and rigidity, and as they are too expensive to be disposable there is the additional problem of their return.

Another aspect of the present invention proceeds from the recognition that it is an unnecessary expense to employ a rigid container. No container, however strong, will withstand a determined attempt to breach it. All that is in practice necessary is to be able to determine immediately and with certainty that a breach has occurred so that the culprit can be identified.

In accordance with a first aspect of the present invention there is provided apparatus for the storage and transport of bank notes comprising an enclosure, a tray slideable into and out of the enclosure in a first direction, the tray being adapted to receive one or more bank notes but having a bottom opening and/or openable bottom, a plunger moveable within the enclosure in a second direction generally perpendicular to the first direction to displace one or more bank notes upon the tray through the bottom of the tray and storage means removably positioned within the enclosure on the opposite side of the tray to the plunger to accept said note or notes when displaced through the tray bottom.

In use of the apparatus said first direction is preferably generally horizontal and said second direction is preferably generally vertical.

In a preferred embodiment of the invention flaps are hinged to parallel sides of the tray and are biassed to adopt a generally co-planar attitude and the plunger is adapted to deflect said flaps toward the storage means to facilitate displacement of said note or notes out of the tray and thereafter to allow the flaps to resume the co-planar attitude.

The storage means is preferably adapted to lie in a lower region of the enclosure beneath the tray, the enclosure having a lockable door whereby access may be had to the storage means to remove it from and replace it in the enclosure, the storage means having an open top provided with inward projections adapted to prevent a note which has passed the projections under the influence of the plunger from re-emerging from the storage means.

Preferably there are rotatable with the barrel of the door lock an eliptical cam and a radially projecting arm, the cam acting on plungers which extrude from sides of the door to engage sides of the enclosure and the arm being movable between positions in which it engages the tray to prevent withdrawal of the tray from the enclosure and tray-releasing positions.

Said projections may take the form of flaps hinged to parallel sides of the upper region of the storage means, said flaps of the storage means being biassed to remain in a co-planar attitude, stop means being provided to prevent said flaps of the storage means rising toward the tray and said flaps of the storage means being deflectable inwardly of the storage means together with the flaps of the tray as the plunger moves in said second direction.

Parallel sides of the top of the storage means may be provided with channels into which a cover plate can be slid to close the storage means.

The interiors of the channels and the side edges of the cover plate are preferably provided with opposite saw-tooth formations whereby the cover plate can be slid through the channels only in one direction.

The leading end of the cover plate preferably has a tongue which enters a correspondingly shaped, flexible, hollow formation of the storage means when the cover plate fully closes the storage means, the arrangement being such that the tongue must be broken off and the hollow formation bent down before the cover plate can be removed by continued movement in the same direction.

The storage means is preferably retained in the enclosure by a catch which is disengaged by the cover plate as the latter closes the storage means.

End edges of the flaps of the storage means may have protrusions which are forced past the adjacent end member of the storage means by the plunger, the protrusions engaging the underside of said end member when the plunger is withdrawn.

The enclosure may be a box-like structure of generally rectangular section a front face of which is formed intermediate its top and bottom with a slot through which the tray can be inserted and withdrawn, and a door below said tray slot for access to the storage means.

Preferably a lever is pivotable about a horizontal axis in the rear region of the enclosure and the plunger has trunnions which extend through vertical slots in opposite side walls of the enclosure, the trunnions engaging in cam slots in the lever on opposite sides of the enclosure and the arrangement being such that as the lever is pivoted the plunger will be raised and lowered while remaining in the same angular attitude relative to the tray.

The lever may be generally U-shaped, having a web portion extending across said front face of the enclosure, the arrangement being such that access to the door in said front face is prevented by said web portion unless the lever is in its raised position.

A latch is preferably provided in the enclosure which will engage the tray when the latter is fully within the enclosure and a cam is movable with the lever to disengage the latch when the lever is depressed, thereby permitting withdrawal of the tray only after the lever has been operated to remove a note or notes in the tray into the storage means.

Means is preferably provided whereby the lever displaces the tray simultaneously with disengagement of the latch so that when the lever is raised the latch will not re-engage the tray.

Means is preferably provided whereby the lever cannot be moved from its fully raised to its fully lowered position unless the tray is engaged by the latch.

The storage means may comprise an open-topped carrier and a removable frame located in the top of the carrier, the frame being spanned by a flexible material which will form a bag to enclose a note or notes pressed through the frame by the plunger.

The flexible material is preferably an elasticated material.

Said flaps of the storage means may be hinged to longer parallel sides of the frame.

The channels to receive the cover plate may be provided along longer parallel sides of the frame.

The frame may be removably snap fitted into the top of the carrier.

In accordance with another aspect of the present invention there is provided a tamper-evident enclosure for the storage and transport of bank notes, the enclosure comprising a frame spanned by a flexible material, the frame having parallel sides provided with channels which receive side edges of a cover plate, the channels and said side edges having opposite saw-tooth formations whereby the cover plate can be slid along the channels only in one direction, a leading end of the cover plate being provided with a tongue which enters a correspondingly shaped hollow, flexible formation at the leading end of the frame as the cover plate fully closes the frame, the arrangement being such that the cover plate can be removed from the frame only after breaking off said tongue and bending down said hollow formation.

Said flexible material is preferably an elasticated material which will deform to provide a bag for bank notes pushed through the frame.

Preferred embodiments of the present invention will now be described by way of non-limitative example with reference to the accompanying drawings, in which.

Figure 15:
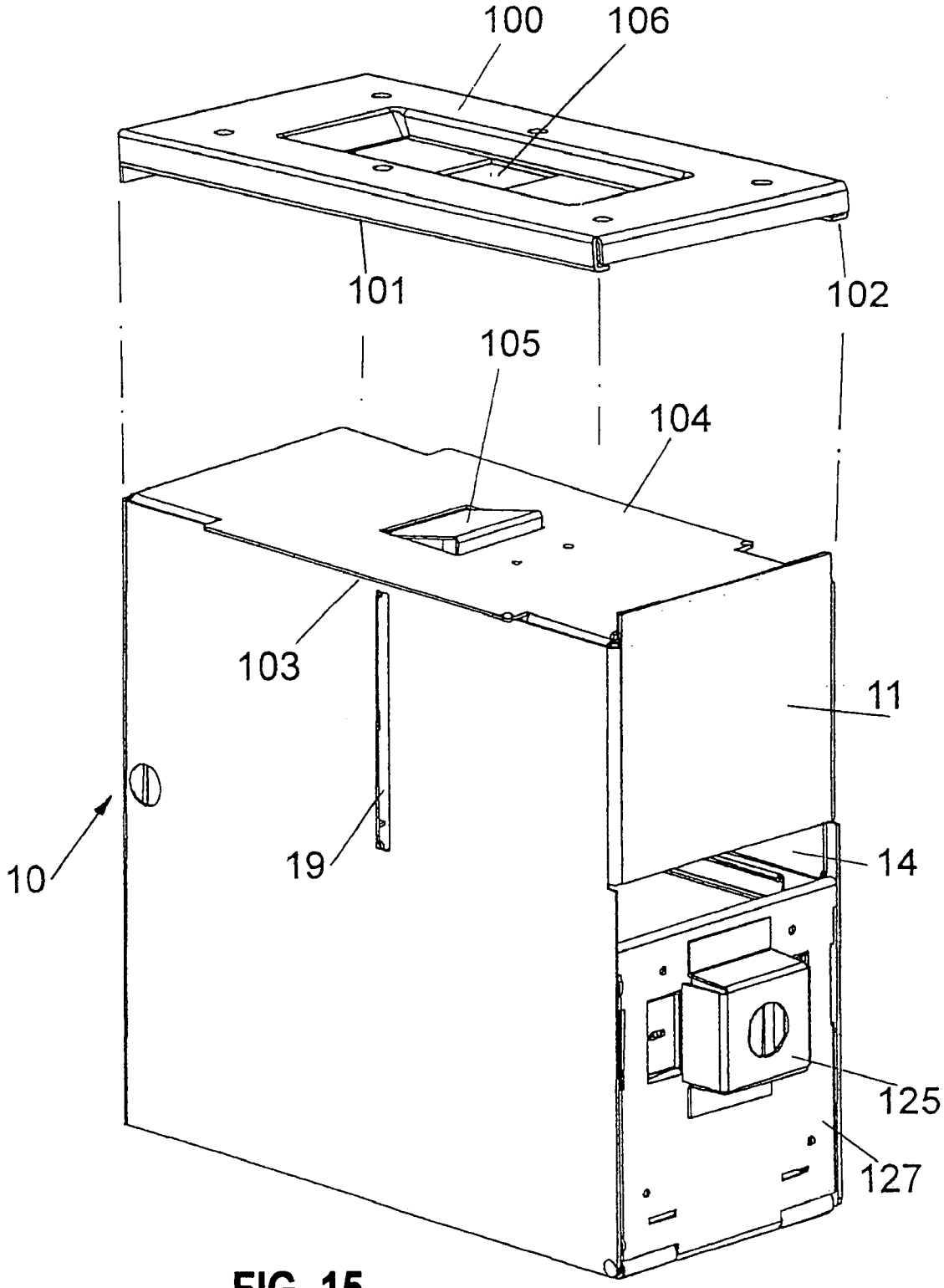
FIG. 15 is a perspective view of the housing with the face plate of its door removed, showing also a mounting plate by which it is suspended.

The box-like enclosure 10 illustrated in FIGS. 1 to 3 and 11–15 may be free-standing but will normally be suspended by its top beneath a counter within easy reach of a cashier. Referring to FIG. 15, a mounting plate 100 is screwed to the underside of a counter (not shown). The mounting plate has lateral, L-shaped channels 101,102 into which lateral flanges 103,104 at the top of the box 10 can be slid. As the box 10 reaches its final position a spring-loaded catch 105 in the top of the box engages a square opening 106 in the mounting plate 100. The box 10 cannot now be removed from the mounting plate 100 without first gaining access to the interior of the box 10 so as to pull down the catch 105 from the opening 106. The front 11 of the box rises slightly above its top. With the top of the front 11 butted against the edge of the counter access is denied e.g. with a screw-diver between the top of the box and the underside of the counter to release the catch 105.

Figure 10:
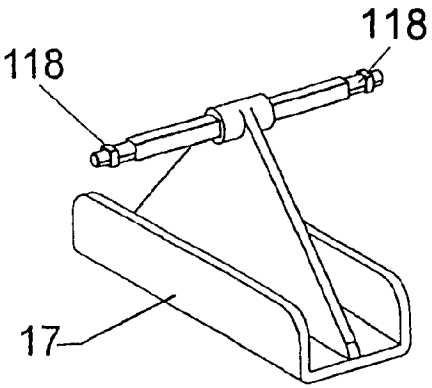
FIG. 10 illustrates the plunger of the apparatus of FIGS. 1–4 in isolation.
Figure 24:
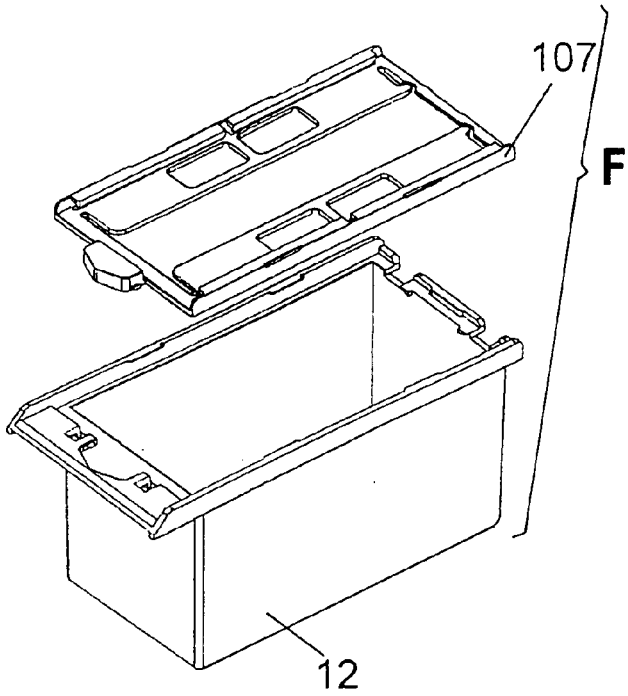
FIGS. 24–25B illustrate how the bag frame is seated in its carrier, FIGS. 25A and 25B showing on a larger scale how a detail of the bag frame works.
Figure 25A:
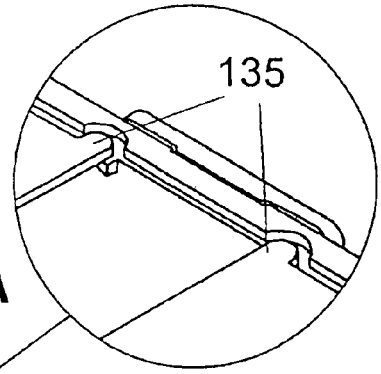
Figure 25:
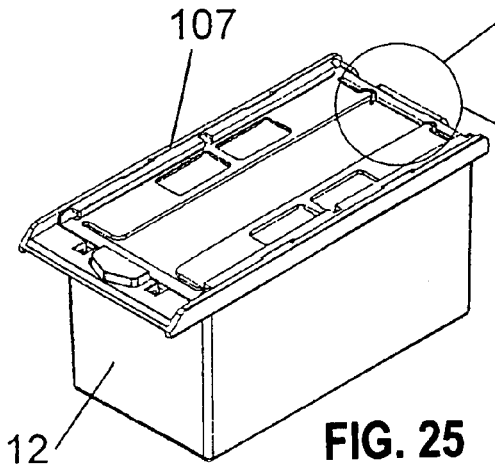

In a lower part of the front 11 of the box is a lockable drop-down door 127 giving access to a removable bank note storage carrier 12 (FIGS. 24 and 25). A tray 13 is slideable into and out of the enclosure 10 through a slot 14 in front face 11 above the door, but a stop (not shown) is provided to prevent complete removal of the tray from the enclosure. A U-shaped lever 15 external to the enclosure is movable about a horizontal axis 16 at the back of the enclosure. Within an upper part of the enclosure is a vertical plate-like plunger 17 (shown in isolation in FIG. 10). This is connected to the lever 15 by trunnions 18 which travel both in vertical slots 19 in opposite walls of the enclosure and in cam slots 20 of the lever, the effect being that when the lever is lifted or lowered, rotating about its axis 16, the plunger 17 moves vertically within the enclosure substantially without moving angularly.

The bottom of the tray 13 is formed by two flaps 21 and 22. These are hinged along parallel sides of the tray 13 so as to be deflectable downwardly but stop means (not shown) is provided which prevents them rising above the co-planar attitude in which they are shown in FIGS. 1,2,5 and 9. Biassing or spring means (not shown) is provided which returns the flaps 21,22 to the co-planar attitude after they have been deflected downwardly.

The carrier 12 has snap-fitted into its open top a frame 107 across the underside of which is stretched a piece 108 of elasticated material. The frame 107 has hinged lateral flaps 21A,22A similar to the flaps 21,22 of the tray except that they do not extend fully across the frame 107. After deflection downward into the carrier 12 the flaps 21A,22A will tend to resume the co-planar attitude under the influence of the elasticated material 108.

The operation of the machine will now be described with particular reference to FIGS. 1–9.

Figure 1:
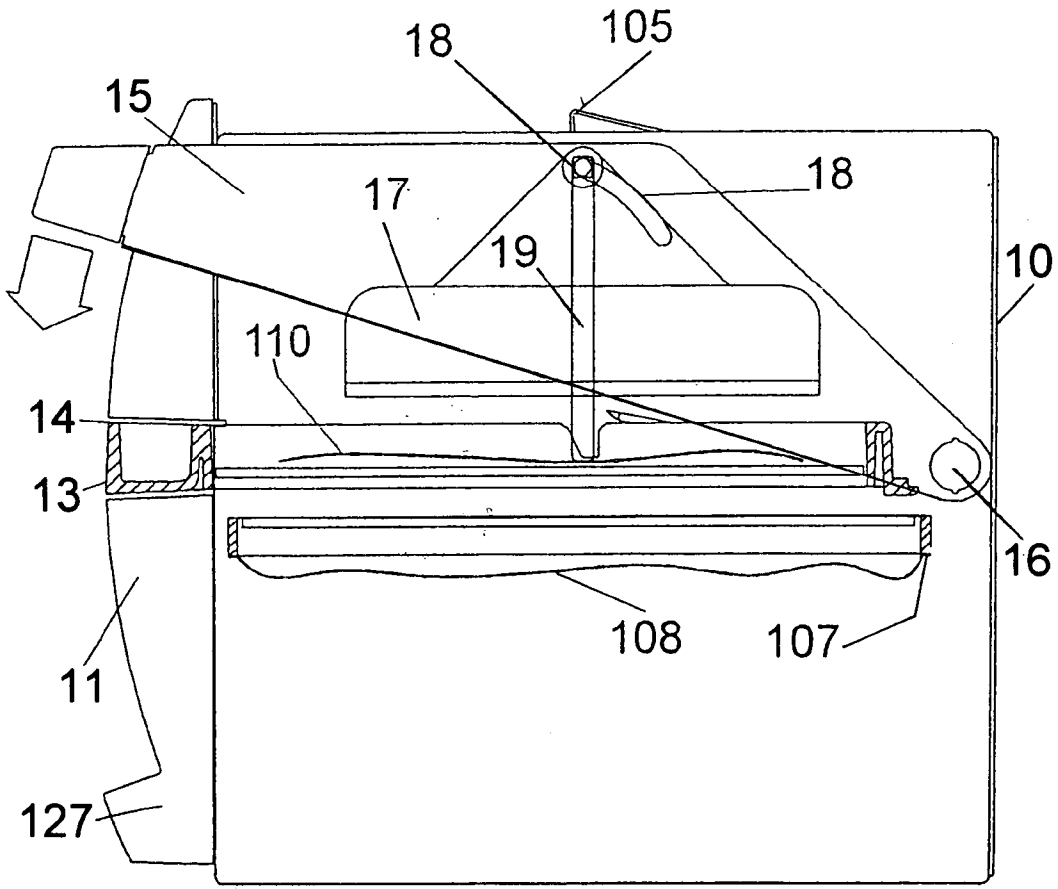
FIGS. 1 and 2 are respectively a side sectional elevation and a front sectional elevation of apparatus in accordance with the invention.
Figure 2:
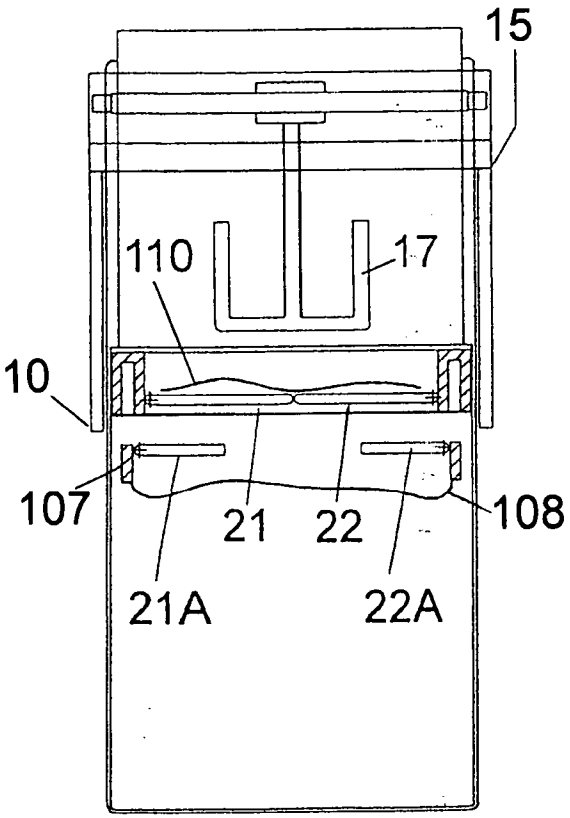
Figure 3:
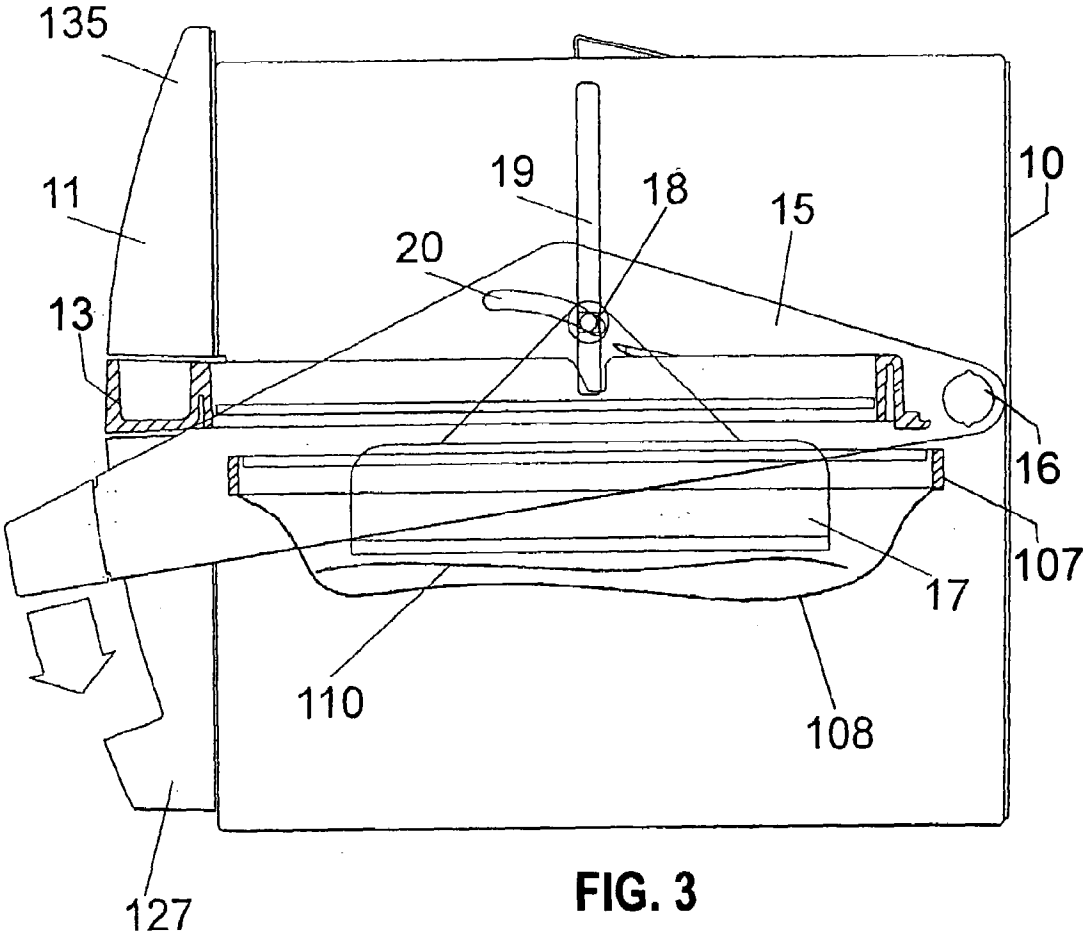
FIGS. 3 and 4 are views similar to FIGS. 1 and 2, respectively, showing components in different positions.
Figure 4:
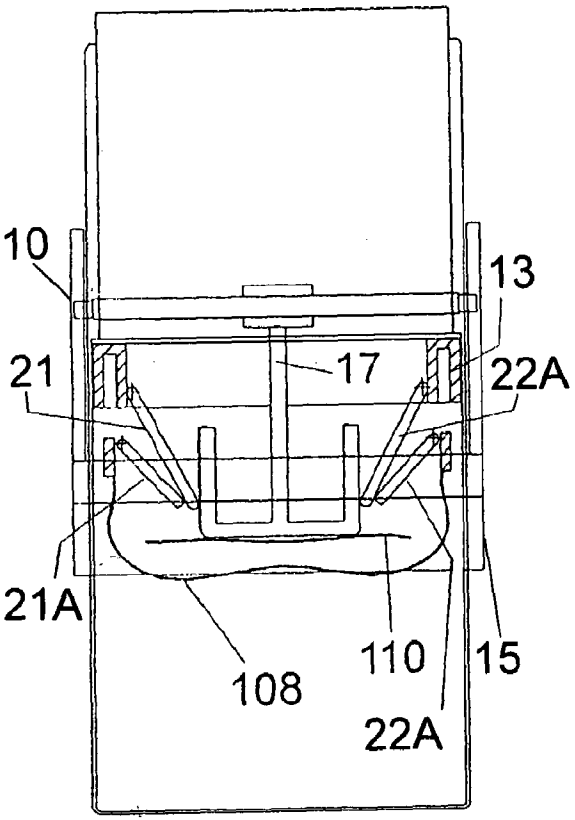
Figure 7:
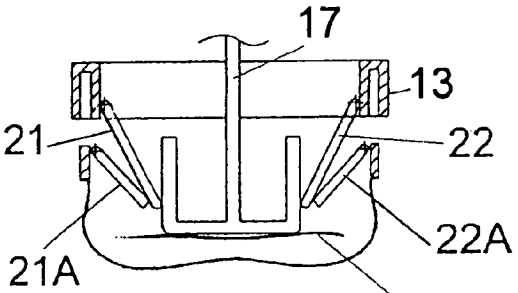
FIGS. 5–9 illustrate how the apparatus of FIGS. 1 to 4 is used to displace bank notes from the tray into a subjacent flexible bag, which can be subsequently sealed and removed from the apparatus.

With the lever 15 in the raised position of FIG. 1 the plunger 17 is raised above the tray 13. The tray 13 can be slid out of the enclosure so that a bank note 110, more usually a pile or wad of bank notes, can be placed in the tray which is then slid back into the enclosure 10.

Figure 6:
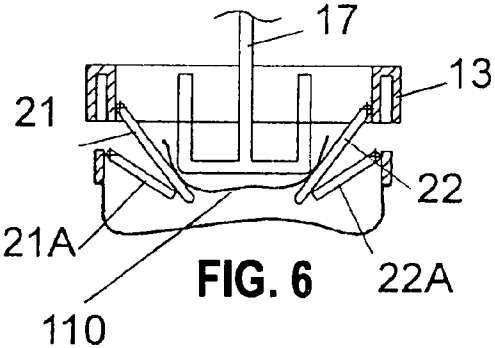
Figure 9:
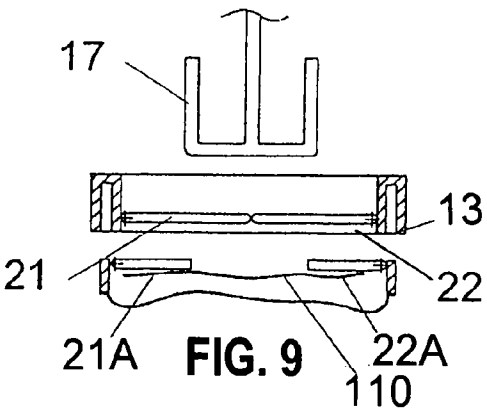
Figure 5:
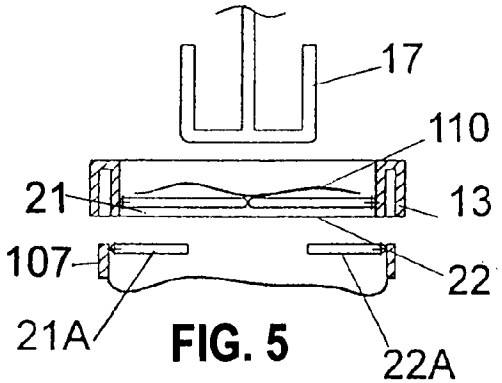
Figure 8:
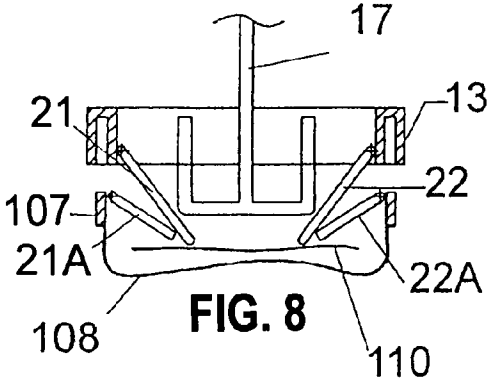

When the lever 15 is depressed (FIGS. 3 and 4) the plunger 17 presses down on any note or notes 110 in the tray, causing the flaps 21 and 22, as well as the flaps 21A and 22A, to deflect downwards (FIG. 6). Once the note 110 has passed the flaps 21A,22A (FIG. 7) it will spread out so as to be caught behind the flaps 21A,22B of the frame 107. When the lever 15 is now raised again both sets of flaps 21A,22A and 21,22 spring back to the co-planar attitudes (FIGS. 8 & 9) as they cease to be deflected by the rising plunger 17. The cycle can now be repeated until the distended "bag" 108 can accept no more notes.

Figure 26:
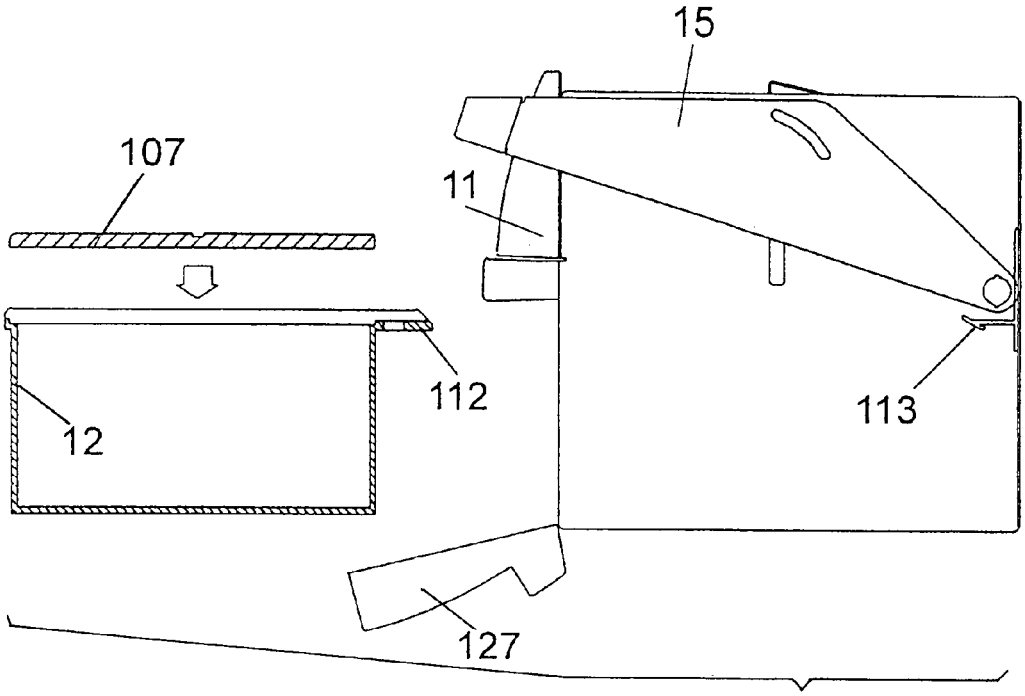
FIGS. 26–30 illustrate the insertion of a closure plate to seal a full bag, simultaneously releasing the carrier so that it can be withdrawn, the positioning of a new frame in the carrier and its re-insertion into the enclosure.
Figure 27:
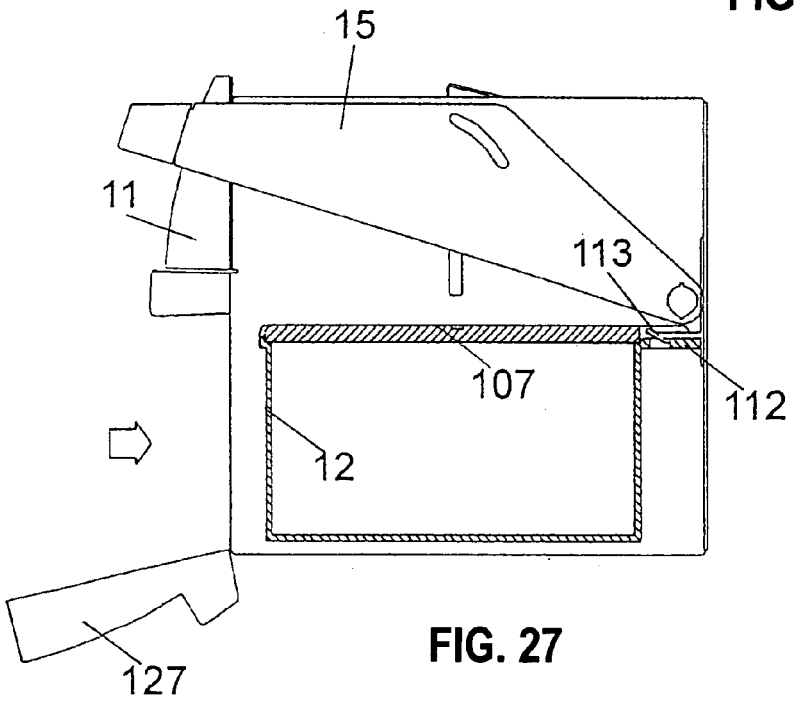
Figure 28:
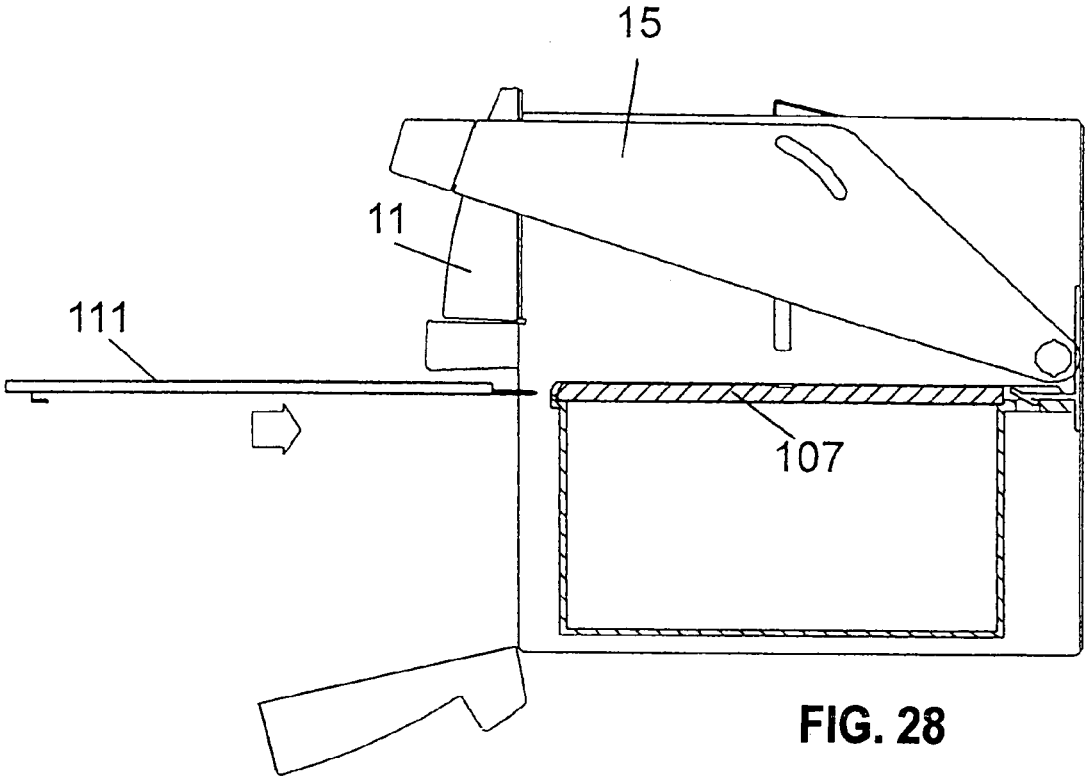
Figure 29:
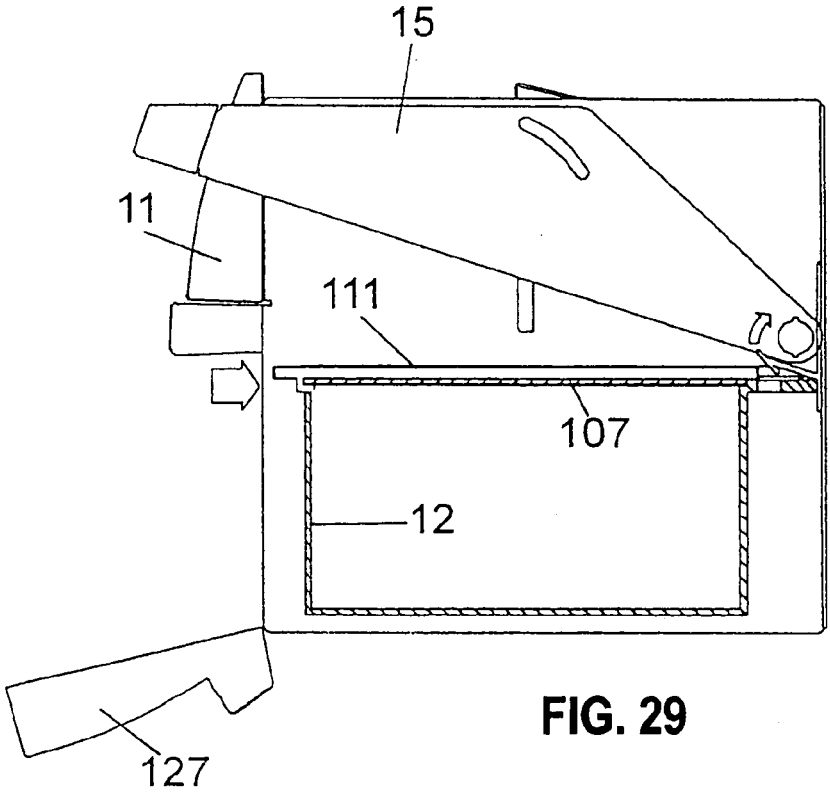
Figure 30:
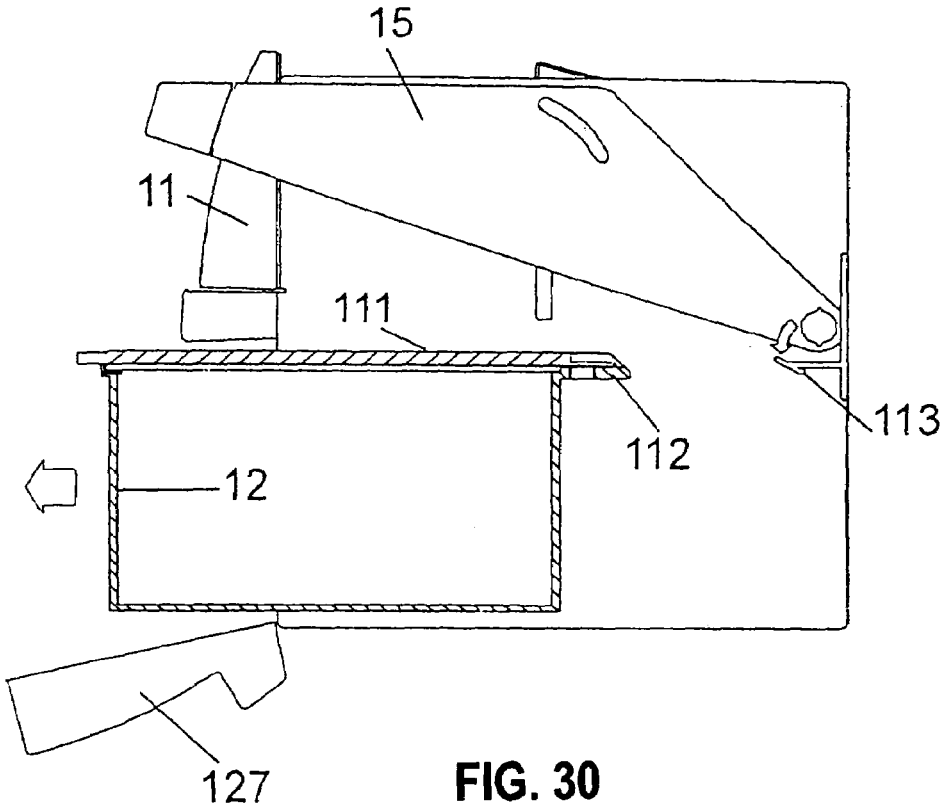

To remove the full bag 108 from the enclosure 10 its door 127 is opened (FIG. 28). At this point however the carrier 12 on which the frame 107 is mounted cannot be pulled out of the enclosure. When the carrier 12 was pushed into the enclosure projections 112 at the back of the carrier first lifted and then engaged with respective catches 113 at the back of the enclosure. To enable removal of the carrier 12 from the enclosure first a closure plate 111 must be slid into L-shaped flanges 113 and 114 along the sides of the frame 107 until chamfered projections 115 and 116 at the leading end of the closure plate 111 lift the catches 113 out of the openings of the projections 112 (FIG. 29). The carrier 12 can now be removed from the enclosure (FIG. 30), after which the frame 107, together with the bag 108 and the cover plate 111, is removed from the carrier 12. A new frame 107 with stretched material 108 can now be snap fitted into the top of the carrier 12 (FIG. 26) and as the latter is slid back into the enclosure the openings in its projections 112 re-engage the catches 113.

By this arrangement the frame 107 must be sealed by a cover plate 111 before it can be removed from the enclosure. With the door 127 open and before inserting a cover plate 111 there is insufficient space above the carrier 12 to enable notes to be "fished" out of the bag 108. The notes are in any event in compression between the material 108 and the undersides of the flaps 21A,22A of the frame 107.

After removal from the carrier 12 the notes within the "bag" 108 are fully sealed by the cover plate 111 which closes the frame 107. Hooks 114 at the back of the cover plate 111 extend over the rear edge of the bag 108 and will have to be broken if the latter is pulled away from the frame 107 to gain access to the notes within the bag.

Figures 22, 22A, 23, 23A, 23B:
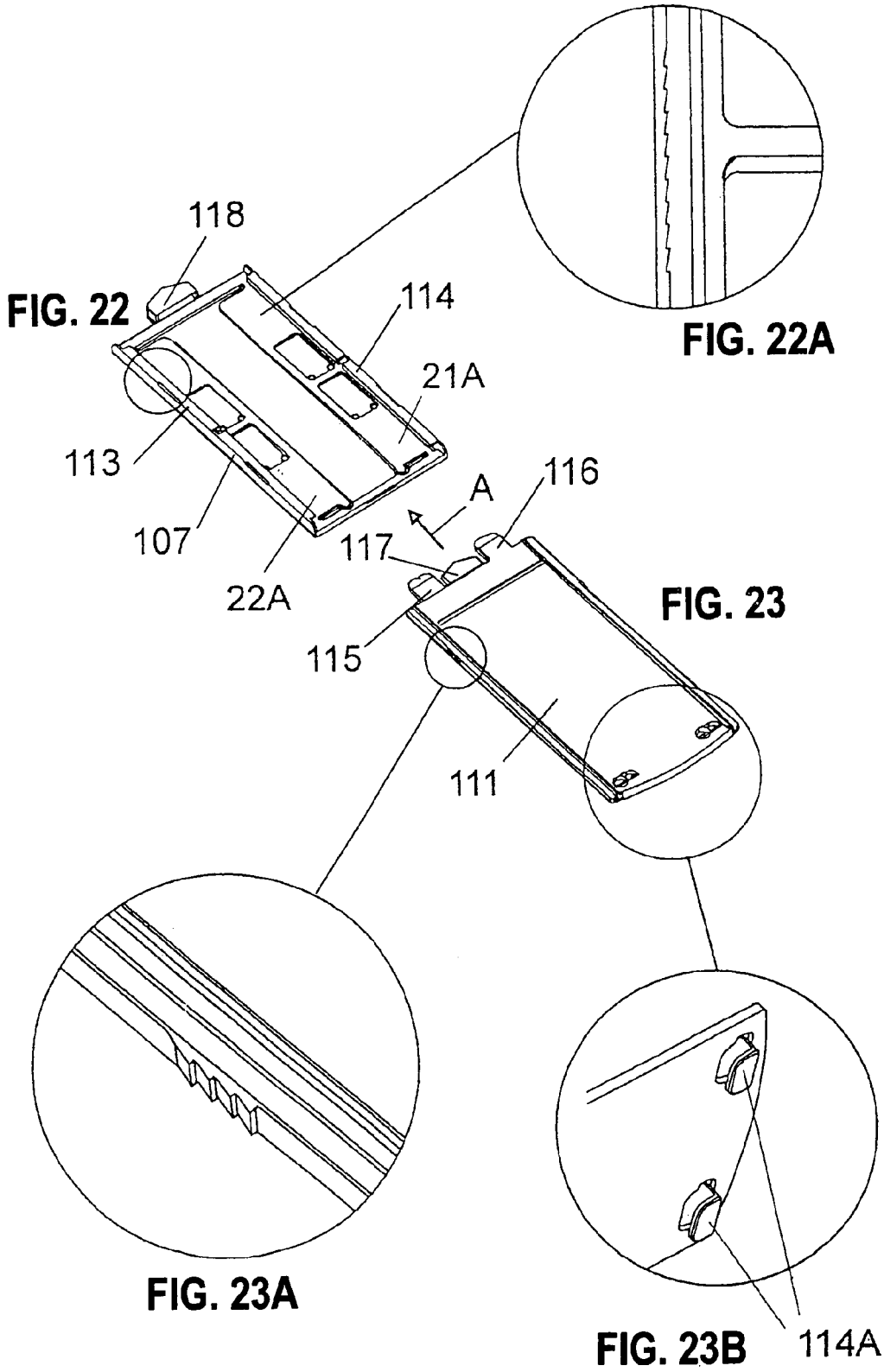
FIGS. 22–23B illustrate the cooperation between the bag frame and a closure plate.

As shown in FIGS. 22A and 23A the sides of the cover plate 111 and the interiors of the flanges 113 and 114 of the frame 107 have reverse saw-teeth formations such that the cover plate 111 can only move relative to the frame 107 in the direction indicated by the arrow "A" in FIG. 23. As the cover plate 111 slides into its final position closing the frame 107, and lifting the catches 113 by means of the projections 115,116, a tongue 117 at the leading end of the cover plate 111 enters a correspondingly shaped, hollow formation 118 at the leading end of the frame 107. Therefore the cover plate 111 cannot be removed from the frame 107, by further movement in the direction of arrow A, until both the hooks 114A and the tongue 117 have been snapped off, the formation 118 being flexible and bending down to allow passage of the cover plate. Meanwhile if any of these tamper-proofing items 114, 117,118 have been damaged there will be visible evidence that an attempt has been made to remove money from the bag 108. Damage to the bag 108 itself would of course also be indicative of theft.

Figure 12:
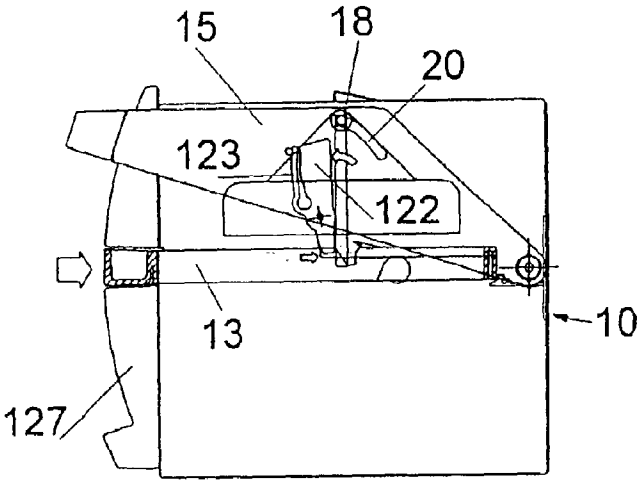
FIGS. 11–14 are views similar to FIG. 1 but showing details omitted from the previous views for clarity.
Figure 14:
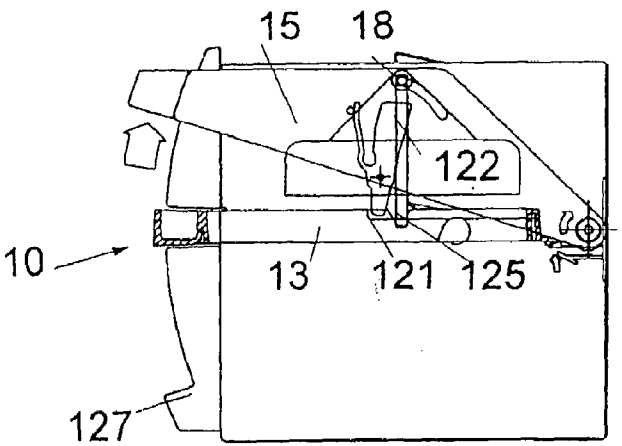
Figure 11:
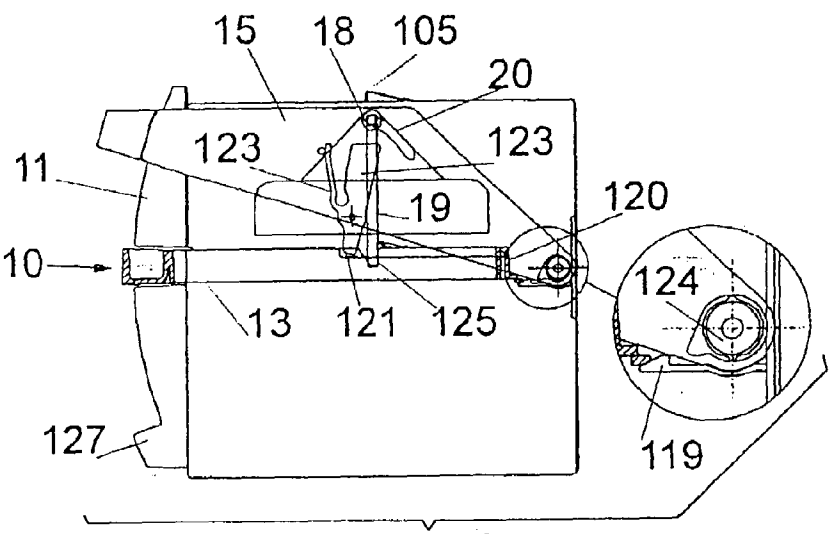
Figure 13:
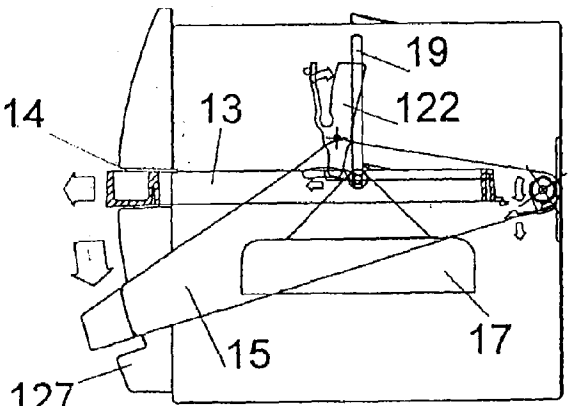

When the tray 13 is first pushed into the enclosure (FIG. 11) a spring-loaded latch 119 at the back of the enclosure 10 engages under a wall 120 at the leading end of the tray, preventing it from being pulled back out again until the lever 15 has been operated. This ensures that money placed in the tray 13 cannot simply be removed again, because before the tray 13 can be pulled out the plunger 17 will have moved notes in the tray into the bag 108. How this is achieved is illustrated in FIGS. 11–14. As the tray 13 enters the enclosure 10 a rebate 121 engages the bottom end of a swivel 122, moving the latter against a bias provided by a resilient extension 123. This moves the swivel 122 out of the way of the trunnions 18 allowing the lever 15 to be depressed (FIGS. 12 and 13). As this occurs a cam 124 rotating with the lever 15 depresses the latch 119. In their fully descended position the trunnions 18 encounter ramps 125 in the sides of the tray 13, "nudging" it outward (FIGS. 13 and 14), so that when the lever 15 is now raised again, allowing the latch 119 to spring back, the latter will fail to re-engage the leading end of the tray. At the same time., as the rebate 121 moves to the left, as viewed, the swivel 122 resumes its former position under the influence of the spring 123. As the trunnions 18 rise they deflect the swivel 122, allowing them to pass, but the lever 15 cannot now be depressed again until the tray 13 has been pushed fully into the enclosure, so that the rebate 121 once again acts on the swivel 122.

Figure 18:
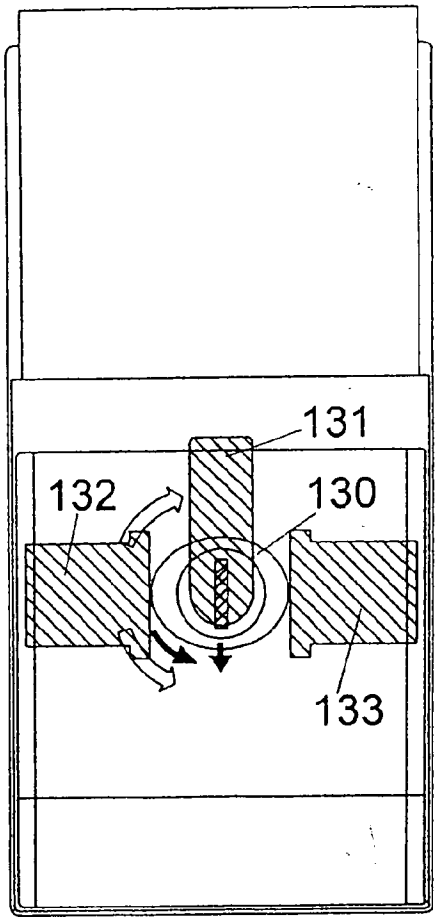
FIGS. 16–18 are front views of the apparatus illustrating the three positions of the door lock.
Figure 17:
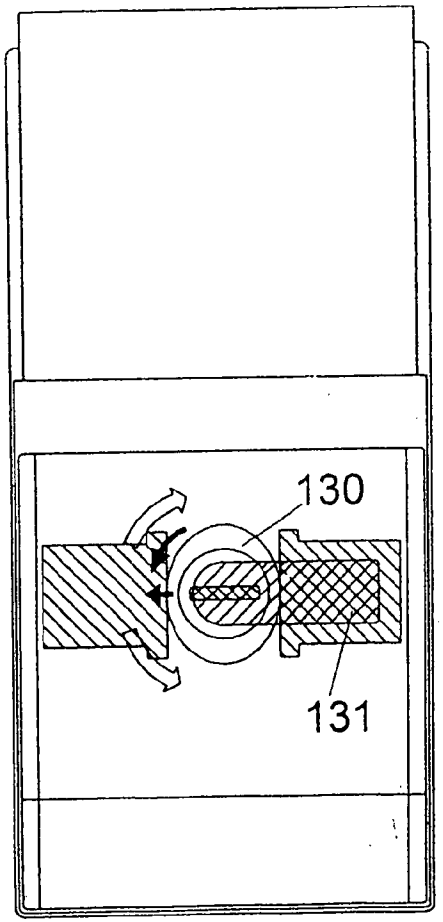
Figure 16:
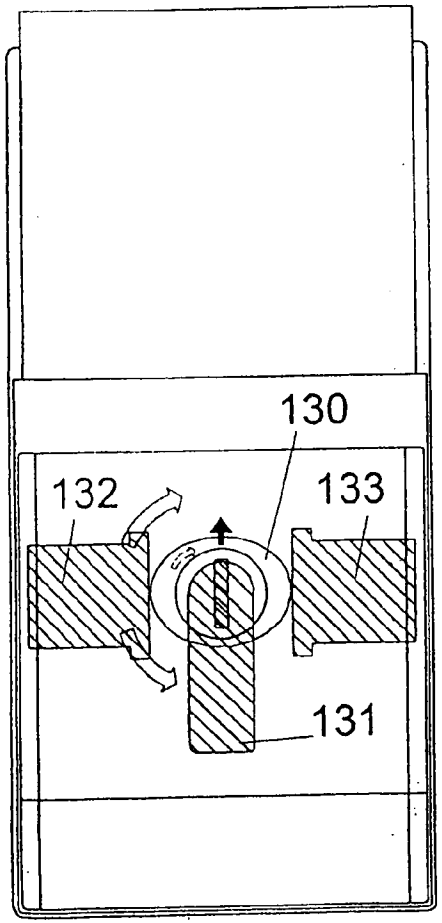
Figure 21:
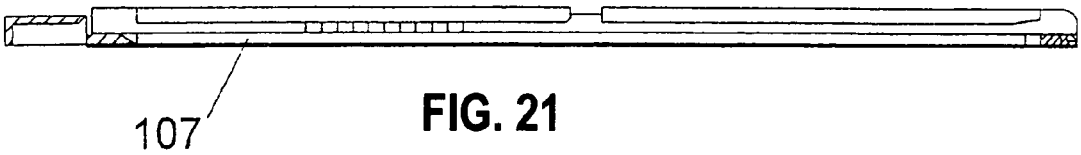
FIGS. 19–21 are respectively an underside view, a top view and a side elevation of the disposable bag and its frame.
Figure 19:
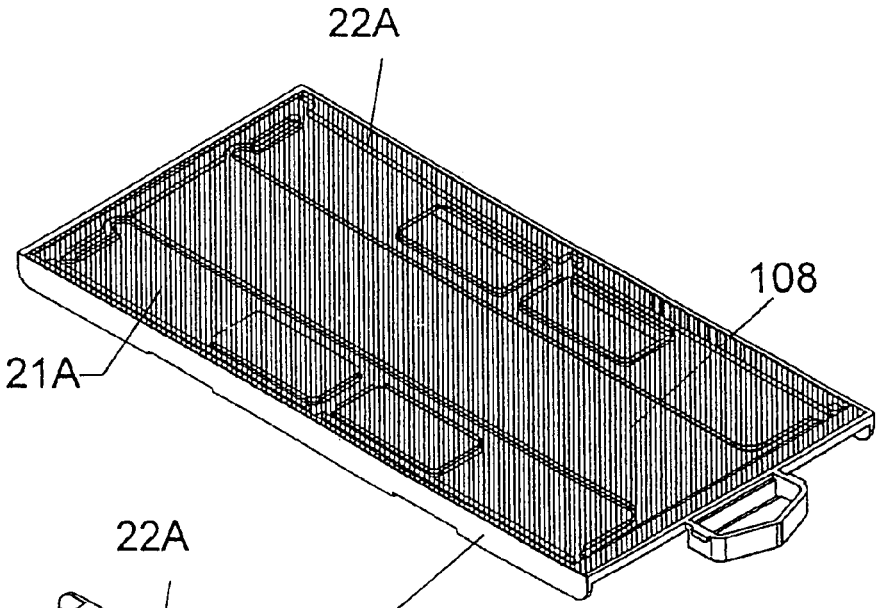
Figure 20:
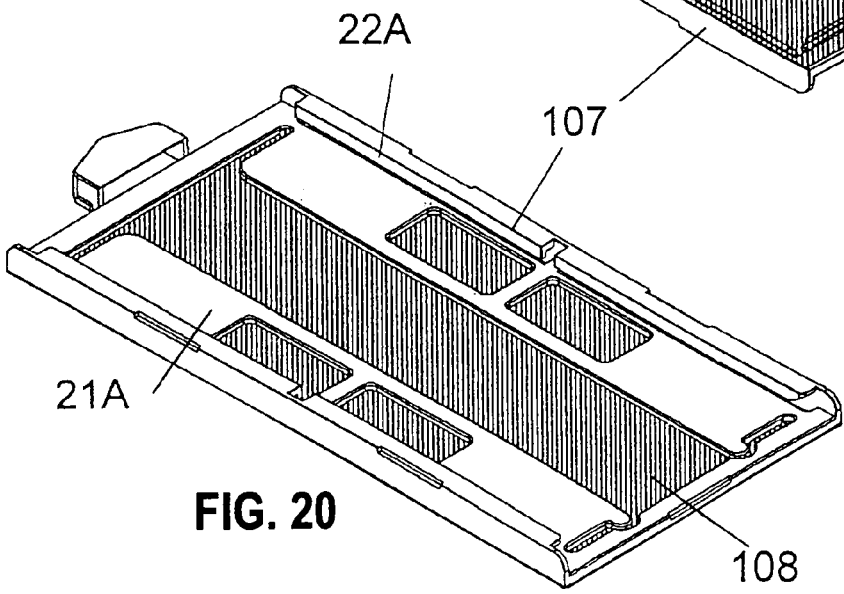

The lock 125 within the hollow door 127 (FIGS. 15–18) offers the possibilities of locking only the door (FIG. 16), unlocking the door (FIG. 17) and locking both the door and the tray 13 (FIG. 18) by suitable rotation of the key (not shown). Rotating with the barrel of the lock is an elliptical cam 130 and a latch 131. When rotated between the positions of FIGS. 17 and 16 the cam 130 extrudes from the sides of the door plungers 132 and 133 which, when the door is closed, engage in slots in the sides of the enclosure 10. As the cam is rotated from the FIG. 16 position to the FIG. 17 position the plungers 132 and 133 are retracted by respective springs (not shown) enabling the door to be opened. Alternatively if the barrel of the lock is rotated from the position of FIG. 17 not to the position of FIG. 16 but to the position of FIG. 18 the latch 131 is raised simultaneously with extrusion of the plungers 132 and 133 until it engages in a slot (not shown) in the underside of the tray 13. In this position of the lock the door cannot be opened and the tray 13 cannot be slid out of the enclosure.

Figure 25B:
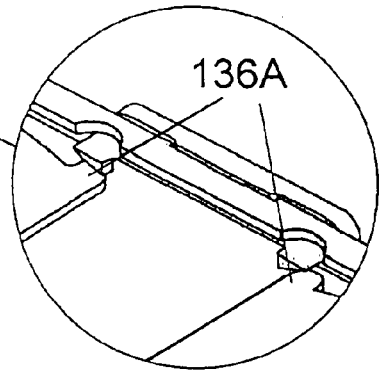

FIGS. 25A and 25B illustrate a feature of the flaps 21A,22A of the frame 107. Each flap has at one of its end edges at a position spaced from the hinged side of the flap a rounded protrusion 135 which normally rests in a recess 136 in the adjacent end member of the frame 107. The first time the plunger 17 depresses the flaps 22A,22B the protrusions 135 pass below the recesses 136. When the plunger 17 is retracted and the flaps 22A,22B are moved back toward the horizontal by the elasticity of the bag 108 they are stopped by the protrusions 135 encountering the chamfered undersides 136A of the recesses 136. Thus there is no possibility that the flaps 22A,22B will rise above the horizontal, which could prevent the subsequent insertion of the closure plate 111 into the channels on either side of the frame 107.

It is to be understood that use of a frame-and-bag assembly 107,108 is optional. The carrier 12 could simply be replaced by a cassette (not shown) of similar dimensions having flaps hinged to its longer side edges. The cassette would be adapted for the reception of a cover plate similar to the plate 111 in the same way as the frame 107, i.e. by having channels along its longer sides. A tamper proof arrangement similar to that provided by the items 117 and 118 could be provided, although the hooks 114A would be unnecessary.

The invention claimed is:

1. An apparatus for the storage and transport of bank notes comprising:

an enclosure;

a tray slideable into and out of the enclosure in a first direction, the tray being adapted to receive at least one bank note but having an openable bottom;

a manually operable plunger moveable within the enclosure in a second direction generally perpendicular to the first direction to displace said at least one bank note into a bank note receptacle removably positioned within the enclosure on the opposite side of the tray to the plunger, the tray bottom being biased to a closed position from which it can be deflected by the plunger enabling the plunger to pass through the tray bottom when the tray is received in the enclosure thereby to displace said at least one bank note from the tray into said bank note receptacle the tray bottom resuming its closed position when the plunger is withdrawn from the bank note receptacle; and wherein the bank note receptacle is adapted to lie in a lower region of the enclosure beneath the tray, the enclosure having a lockable door whereby access may be had to the bank note receptacle to remove it from and replace it in the enclosure, the bank note receptacle having an open top provided with inward projections adapted to prevent a note which has passed the projections under the influence of the plunger from re-emerging from the bank note receptacle.

2. An apparatus for the storage and transport of bank notes comprising:

an enclosure;

a tray slideable into and out of the enclosure in a first direction, the tray being adapted to receive at least one bank note but having an openable bottom;

a manually operable plunger moveable within the enclosure in a second direction generally perpendicular to the first direction to displace said at least one bank note into a bank note receptacle removably positioned within the enclosure on the opposite side of the tray to the plunger, the tray bottom being biased to a closed position from which it can be deflected by the plunger enabling the plunger to pass through the tray bottom when the tray is received in the enclosure thereby to displace said at least one bank note from the tray into said bank note receptacle the tray bottom resuming its closed position when the plunger is withdrawn from the bank note receptacle; and wherein a lever is pivotable about a horizontal axis in the rear region of the enclosure and the plunger has trunnions which extend through vertical slots in opposite side walls of the enclosure, the trunnions engaging in cam slots in the lever on opposite sides of the enclosure and the arrangement being such that as the lever is pivoted the plunger will be raised and lowered while remaining in the same angular attitude relative to the tray.

3. Apparatus for the storage and transport of bank notes, comprising:

a lockable enclosure;

a tray slideable into and out of a slot in the enclosure in a first direction, the tray being adapted to receive one or more bank notes but having a bottom opening and/or openable bottom;

a plunger moveable within the enclosure in a second direction generally perpendicular to the first direction to displace one or more bank notes upon the tray through the bottom of the tray; and a bank note receptacle removably positioned within the enclosure on the opposite side of the tray to the plunger to accept said note or notes when displaced through the tray bottom, wherein a latch is provided to prevent withdrawal of the tray from the enclosure until the plunger has first been actuated.

4. An apparatus as claimed in claim 3, wherein said latch includes a spring-loaded latch which engages a wall at the leading end of the tray, the latch being deflected to release the tray by a cam which rotates when the plunger is actuated.

5. An apparatus as claimed in claim 4, wherein in use of the apparatus said first direction is generally horizontal and said second direction is generally vertical.

6. An apparatus as claimed in claim 3, wherein the enclosure is a structure of generally rectangular sections, a front face of which is formed intermediate its top and bottom with said slot through which the tray can be inserted and withdrawn, and a lockable door below said tray slot for access to the bank note receptacle.

7. An apparatus as claimed in claim 6, wherein a lever is pivotable about a horizontal axis in the rear region of the enclosure and the plunger has trunnions which extend through vertical slots in opposite side walls of the enclosure, the trunnions engaging in cam slots in the lever on opposite sides of the enclosure and the arrangement being such that as the lever is pivoted the plunger will be raised and lowered while remaining in the same angular attitude relative to the tray.

8. An apparatus as claimed in claim 7, wherein the lever is generally U-shaped, having a web portion extending across a front face of the enclosure, the arrangement being such that access to a door in said front face is prevented by said web portion unless the lever is in its raised position.

9. An apparatus as claimed in claim 7, wherein a swivel is provided whereby the lever displaces the tray simultaneously with disengagement of the latch so that when the lever is raised the latch will not re-engage the tray.

10. An apparatus as claimed in claim 7, wherein an extension is provided whereby the lever cannot be moved from its fully raised to its fully lowered position unless the tray is engaged by the latch.

11. An apparatus as claimed in claim 3, wherein flaps are hinged to parallel sides of the tray and are biased to adopt a generally co-planar attitude and wherein the plunger is adapted to deflect said flaps toward the bank note receptacle to facilitate displacement of said note or notes out of the tray and thereafter to allow the flaps to resume the co-planar attitude.

12. An apparatus as claimed in claim 3, wherein the lockable enclosure includes a lockable door, wherein the lockable door includes a barrel, wherein an elliptical cam is rotatable with the barrel and a radially projecting arm, the cam acting on door plungers which extrude from the sides of the door to engage sides of the enclosure and the arm being movable between positions in which it engages the tray to prevent withdrawal of the tray from the enclosure and tray-releasing positions.

13. An apparatus as claimed in claim 3, wherein the bank note receptacle has an open top provided with inward projections adapted to prevent a note which has passed the projections under the influence of the plunger from re-emerging from the bank note receptacle.

14. An apparatus as claimed in claim 13, wherein said projections take the form of flaps hinged to parallel sides of the upper region of the bank note receptacle, said flaps of the bank note receptacle being biased to remain in a co-planar attitude, a protrusion is being provided to prevent said flaps of the bank note receptacle rising toward the tray and said flaps of the bank note receptacle being deflectable inwardly of the bank note receptacle together with the flaps of the tray as the plunger moves in said second direction.

* * * * *